United States Patent [19]

McCarten et al.

[11] Patent Number: 5,062,924

[45] Date of Patent: Nov. 5, 1991

[54] BLANKET FOR AN EXTENDED NIP PRESS WITH ANISOTROPIC WOVEN BASE LAYERS

[75] Inventors: Paul McCarten, Scranton; Eugene Slagowski, Waverley, both of Pa.

[73] Assignee: Beloit Corporation, Beloit, Wis.

[21] Appl. No.: 560,402

[22] Filed: Jul. 31, 1990

Related U.S. Application Data

[63] Continuation-in-part of Ser. No. 179,086, Apr. 8, 1988, Pat. No. 4,944,820.

[51] Int. Cl.[5] ..... D21F 3/02; B32B 3/30

[52] U.S. Cl. ..... 162/358; 428/259; 428/167; 198/847

[58] Field of Search ..... 162/358, 361; 428/258, 428/259, 167; 474/268, 271; 198/846, 847

[56] References Cited

U.S. PATENT DOCUMENTS

| | | | |
|---|---|---|---|
| 4,353,296 | 10/1982 | Beucker | 162/358 |
| 4,559,258 | 12/1985 | Kiuchi | 162/358 |
| 4,880,501 | 11/1989 | Schiel | 162/358 |
| 4,908,103 | 3/1990 | Cronin et al. | 162/358 |
| 4,946,731 | 8/1990 | Dutt | 162/358 |

*Primary Examiner*—Karen M. Hastings

*Attorney, Agent, or Firm*—Dirk J. Veneman; Raymond W. Campbell; David J. Archer

[57] ABSTRACT

A blanket is disclosed for an extended nip press. The blanket includes a woven base having a first plurality of filaments which are disposed in a machine direction. The first plurality of filaments have a modulus of elasticity which permits flexing of the blanket during movement of the blanket through the extended nip press. The base also includes a second plurality of filaments woven together with the first plurality of filaments and disposed in a cross-machine direction. The second plurality of filaments have a modulus of elasticity which is higher than the modulus of elasticity of the first plurality of filaments for inhibiting flexing of the blanket in a cross-machine direction. Thermo-setting resin is applied to the base such that the resin is reinforced by the base. The resin defines a plurality of vents for permitting the escape of water in the liquid and vapor phase away from the extended nip press during use thereof. The second plurality of filaments prevent collapse of the vents during use of the extended nip press due to the higher modulus of elasticity.

15 Claims, 4 Drawing Sheets

BLANKET FOR AN EXTENDED NIP PRESS WITH ANISOTROPIC WOVEN BASE LAYERS

CROSS-REFERENCE TO RELATED ART

This application is a Continuation-in-Part of co-pending U.S. patent application Ser. No. 07/179,086 filed Apr. 8, 1988, now U.S. Pat. No. 4,944,820. All the disclosure of Ser. No. 07/179,086 is incorporated herein by reference.

BACKGROUND OF THE INVENTION

1. Field of the Invention

The present invention relates to a blanket for an extended nip press. More particularly, the present invention relates to a blanket having a woven base reinforcement for use in an extended nip press of a papermaking machine.

2. Information Disclosure Statement

In the papermaking art, paper stock is ejected onto a moving fourdrinier wire such that water within the stock is drained therefrom leaving a formed web thereon. The formed web is subsequently guided between cooperating press members such that excess water within the formed web is pressed therefrom.

The cooperating press members usually include a pair of counter-rotating press rolls which define therebetween a pressing nip for pressing the formed web. However, more recently, extended nip presses have been employed for the removal of such water from the formed web.

An extended nip press essentially includes a rotatable backing roll and a cooperating elongate shoe which is movable towards the backing roll for defining therebetween an elongate pressing nip for pressing water from the formed web. A press blanket extends in a looped configuration through the elongate pressing nip such that the web is disposed between the blanket and the backing roll. Lubrication is provided between the shoe and the blanket such that the blanket slides in a machine direction relative to the shoe for supporting the web during movement of the web through the pressing section.

The aforementioned extended nip press has proved to be very successful in removing greater quantities of water from a formed web when compared with the aforementioned presses having counter-rotating press rolls. Primarily, the reason for such increased water removing capability resides in the increased residence time of the web within the elongate pressing nip.

More particularly, a first felt is disposed between the web and the blanket in order to absorb the water pressed from the web. However, the blanket must, of necessity, be formed of a non-porous material such that the aforementioned lubricant between the shoe and the blanket does not contaminate the first felt and the web. Consequently, it has been found necessary to vent the backing roll such that water pressed from the web is permitted to escape from the vicinity of the elongate pressing nip.

With the provision of a vented backing roll, it has been found necessary to provide a second press felt disposed between the web and the backing roll because otherwise the grooved, or otherwise vented backing roll, would mark the surface of the pressed web.

Accordingly, with the aforementioned double felted extended nip press arrangement, the surface characteristics of the resultant web are less than desirable for the production of writing or printing grade papers because both surfaces of the resultant web exhibit a relatively rough surface texture due to contact with the respective press felts.

Therefore, press blankets have been proposed which define a plurality of machine directional grooves or the like for assisting venting of the elongate press nip. Such vented blankets obviate the need for a vented backing roll and potentially permit the production of a web in which one side of the web directly contacts a smooth external surface of the backing roll, thereby generating a smooth printable surface to the resultant web.

Although the provision of a grooved blanket of the aforementioned type has already been proposed as, for example, in U.S. Pat. No. 4,908,103 to Cronin et al, many problems have been experienced in the practical production of such a blanket.

Amongst such problems is the problem of "barrelling" which is the tendency for the grooved channels defined by the blanket to compress under extended exposure to pressure. The collapse of such grooves greatly impedes the flow of water through these grooves and, in many cases, these "barrel-shaped" grooves completely fail to vent the press nip.

Also, there exists the tendency for a grooved blanket of the aforementioned type to delaminate under the extreme pressures envisaged in an extended nip environment. Such extended nip presses typically operate at pressures in the region of 6,000 pounds per linear inch and such pressures usually cause such grooved blankets to fracture and delaminate after a few hours of use thereof.

The present invention seeks to overcome the aforementioned problems by providing a blanket of polyurethane resin having a woven base reinforcement exhibiting anisotropic characteristics. More particularly, the woven base includes filaments disposed in a machine and a cross-machine direction. The cross-machine directional filaments have a greater stiffness than the filaments disposed in a machine direction such that the blanket is permitted to flex through the elongate pressing section and around the various guide rolls while the stiffness in a cross-machine direction inhibits barrelling of the grooves and delamination of the blanket.

Therefore, it is a primary object of the present invention to provide a blanket which overcomes the aforementioned inadequacies of the prior art blankets and which makes a considerable contribution to the paper pressing art.

Another object of the present invention is the provision of a blanket having anisotropic properties such that the modulus of elasticity of the cross-machine directional filaments of the base is greater than the modulus of elasticity of the machine directional filaments so that the blanket is permitted to flex during passage through an elongate pressing section while delamination of the blanket and barrelling of the grooves defined thereby is inhibited.

Another object of the present invention is the provision of a blanket having anisotropic characteristics and which is vented such that in use thereof, writing and printing grade papers are able to be produced thereby.

Another object of the present invention is the provision of a blanket having anisotropic characteristics, the blanket being formed by saturating a woven base and spirally winding such saturated base onto a mandrel and subsequently removing the resultant blanket from the mandrel after curing and grooving the same.

Other objects and advantages of the present invention will be readily apparent to those skilled in the art by a consideration of the detailed description contained hereinafter taken in conjunction with the annexed drawings.

SUMMARY OF THE INVENTION

The present invention relates to a blanket for an extended nip press and a method of fabricating the same. The blanket includes a woven base which includes a first plurality of filaments disposed in a machine direction. The first plurality of filaments have a modulus of elasticity which permits flexing of the blanket during movement of the blanket through the extended nip press. The base also includes a second plurality of filaments woven together with the first plurality of filaments and disposed in a cross-machine direction. The second plurality of filaments have a modulus of elasticity which is higher than the modulus of elasticity of the first plurality of filaments for inhibiting flexing of the blanket in a cross-machine direction.

Thermo-setting resin is applied to the base such that the resin is reinforced by the base. The resin defines a plurality of vents for permitting the escape of water in the liquid and vapor phase away from the extended nip press during use thereof. The second plurality of filaments prevent collapse of the vents during use of the extended nip press due to the higher modulus of elasticity of the same.

In a more particular embodiment of the present invention, the blanket defines an endless loop such that in use of the blanket, the blanket moves continuously through an extended nip defined by the extended nip press.

The first plurality of filaments are disposed in a warp direction and are of polyester fibers.

In an alternative embodiment of the present invention, the first plurality of filaments, which are disposed in a warp direction, are of nylon fibers.

In various other alternative embodiments of the present invention, the second plurality of filaments, which are disposed in the woof direction, are alternatively of glass, quartz, graphite, aramid, high molecular weight polyethylene, or ceramic fibers.

In a preferred embodiment of the present invention, the thermo-setting resin is polyurethane, which is applied to both sides of the woven base.

Also, in a preferred embodiment of the present invention, the woven base with polyurethane applied to both sides thereof includes a spirally wound base with the spirally wound base having an inner and an outer polyurethane layer coated thereon.

The blanket, according to the present invention, is vented with a plurality of machine directional grooves defined by the thermo-setting resin. The arrangement is such that in use of the extended nip press, water expelled from a felt running contiguously with a formed web and blanket through the extended nip press is channelled away from the extended nip press such that when a backing roll of the extended nip press is a plain roll, sufficient venting of the extended nip press is permitted so that a smooth surface of the plain roll directly contacts the web whereby a smooth surface is imparted to the surface of the web contacting the plain roll.

The resin defines a plurality of vents for permitting the escape of water in the liquid and vapor phase away from the extended nip press during use thereof. The second plurality of filaments prevent collapse of the vents during use of the extended nip press. The mixture imparts a greater stiffness to the blanket in a cross-machine direction relative to the stiffness of the blanket in a machine direction.

In a preferred embodiment of the present invention, the second plurality of filaments are woven together with the first plurality of filaments and are disposed in a cross-machine direction. The second plurality of filaments include a mixture of a first portion of filaments which have a modulus of elasticity which is higher than the modulus of elasticity of the first plurality of filaments, and a second portion of filaments of the second plurality of filaments having a modulus of elasticity approximately the same as the modulus of elasticity of the first plurality of filaments for inhibiting flexing of the blanket in a cross-machine direction and for preventing delamination of the blanket.

In the preferred embodiment of the present invention, the first portion of filaments are of polyester fibers and the second portion of filaments are glass fibers.

The present invention also includes a method of fabricating a blanket for an extended nip press which includes a shoe and a felt. The method includes the sequential steps of weaving a base from a first plurality of filaments disposed in a machine direction and a second plurality of filaments disposed in a cross-machine direction. The first plurality of filaments have a modulus of elasticity which permits flexing of the blanket during movement of the blanket through the extended nip press while the second plurality of filaments have a modulus of elasticity which is higher than the modulus of elasticity of the first plurality of filaments for inhibiting flexing of the blanket in a cross-machine direction.

The woven base is simultaneously saturated on both sides thereof with polyurethane.

The saturated woven base is then wrapped around a smooth mandrel.

The wrapped mandrel is then heated such that the polyurethane gels.

The wrapped mandrel is then further heated within a heating oven for curing the polyurethane. The cured blanket is then cooled. The blanket is then ground to a uniform thickness, and the outer surface thereof is grooved while the blanket is still supported by the mandrel. Finally, the finished blanket is removed from the mandrel.

More specifically, the saturated woven base is spirally wrapped around the mandrel, and the spirally wound woven base is overlapped during winding such that the saturated woven base attains a thickness which is greater than the required thickness of the finished blanket.

Many modifications and variations of the present invention will be readily apparent to those skilled in the art by a consideration of the detailed description contained hereinafter taken in conjunction with the annexed drawings. However, such modifications and variations do not depart from the spirit and scope of the present invention as defined by the appended claims.

BRIEF DESCRIPTION OF THE DRAWINGS

Similar reference characters refer to similar parts throughout the various embodiments of the present invention.

DETAILED DESCRIPTION OF THE DRAWINGS

Figure 1:
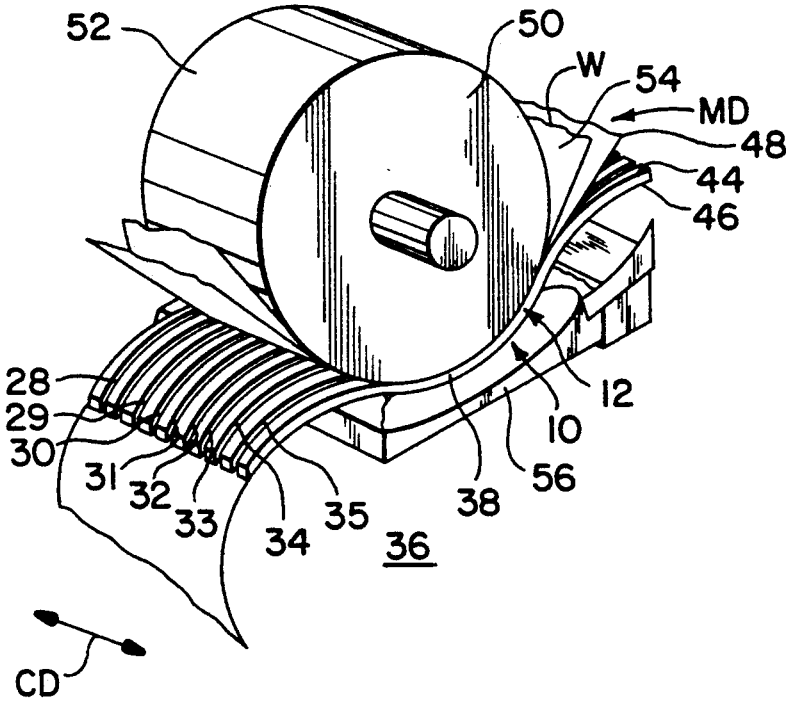
FIG. 1 is a perspective view of an extended nip press showing a blanket according to the present invention extending therethrough.

FIG. 1 is a perspective view of an extended nip press generally designated 10 showing a blanket, according to the present invention, extending therethrough.

Figure 2:
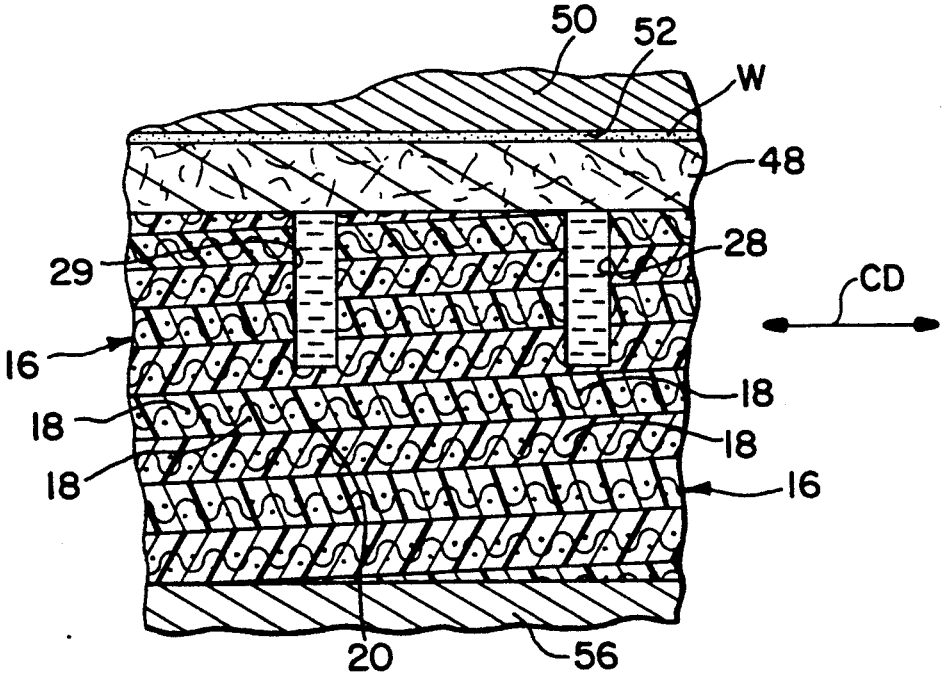
FIG. 2 is an enlarged sectional view of a vented blanket according to the present invention showing the disposition of the web relative to the backing roll.
Figure 4:
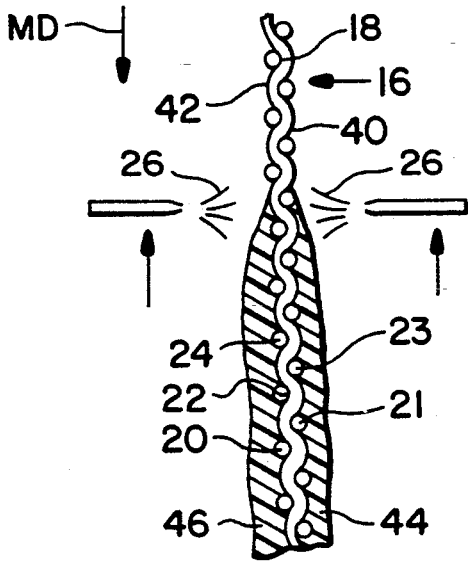
FIG. 4 is a diagrammatic representation showing the initial steps involved in the manufacture of the blanket according to the present invention and shows both sides of a woven base being saturated with polyurethane resin.

The blanket, which is generally designated 12 includes, as shown in FIGS. 2 and 4, a woven base generally designated 16. The base 16 includes a first plurality of filaments 18 disposed in a machine direction as indicated by the arrow MD. The first plurality of filaments 18 have a modulus of elasticity which permits flexing of the blanket 12 during movement of the blanket 12 through the extended nip press 10.

The base 16 also includes a second plurality of filaments 20,21,22,23 and 24 which are woven together with the first plurality of filaments 18 and which are disposed in a cross-machine direction as indicated by the arrow CD. The second plurality of filaments 20–24 have a modulus of elasticity which is higher than the modulus of elasticity of the first plurality of filaments 18 for inhibiting flexing of the blanket 12 in a cross-machine direction CD.

Thermo-setting resin 26 is applied to the base 16 such that the resin 26 is reinforced by the base 16.

Figure 9:
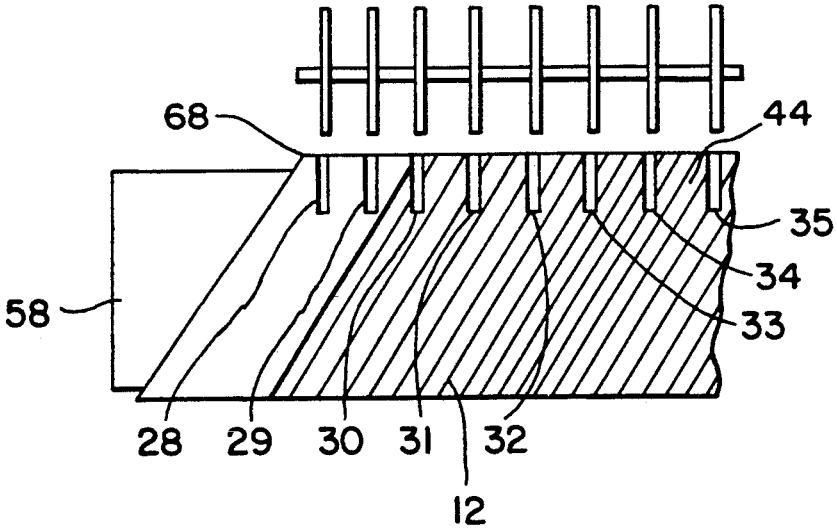
FIG. 9 is a diagrammatic representation of the grooving of the blanket.

The resin 26 defines a plurality of vents 28,29,30,31, 32,33,34 and 35 as shown in FIG. 9 for permitting the escape of water in the liquid and vapor phase away from the extended nip press 10 during use thereof. The second plurality of filaments 20–24 prevent collapse of the vents 28 to 35 during use of the extended nip press 10 due to the higher modulus of elasticity of the filaments 20–24.

As partially shown in FIG. 1, the blanket 12 defines an endless loop 36 such that in use of the blanket 12, the blanket 12 moves continuously through an extended nip 38 defined by the extended nip press 10.

Figure 3:
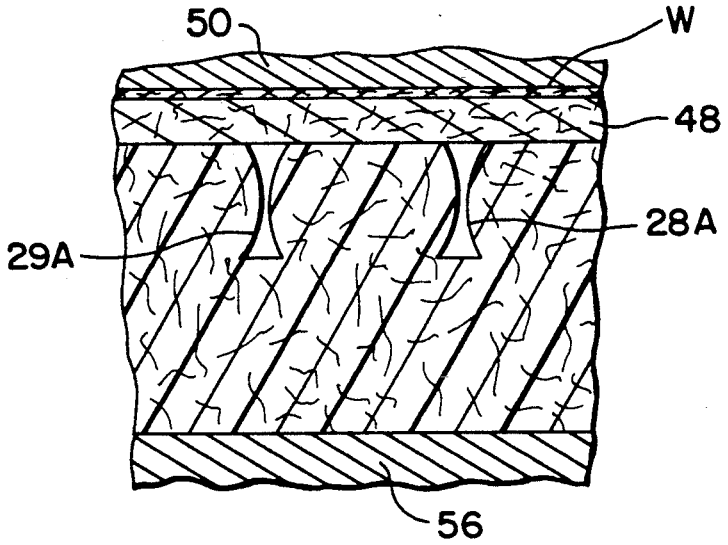
FIG. 3 PRIOR ART
FIG. 3 is a similar view to that shown in FIG. 2 but shows the grooves of a prior art blanket "barrelling" under pressure.

FIG. 3 is a similar view to that shown in FIG. 2 but shows a prior art blanket with the grooves 28A and 29A "barrelling" under pressure.

In one embodiment of the present invention, the first plurality of filaments 18 are disposed in a warp direction MD and are of polyester fibers.

In an alternative embodiment of the present invention, the first plurality of filaments 18 are disposed in a warp direction MD and are of nylon fibers.

In various other embodiments of the present invention, the second plurality of filaments 20–24 are disposed in the woof direction CD and are of either glass, quartz, graphite, aramid, high molecular weight polyethylene or ceramic fibers.

In a preferred embodiment of the present invention, the thermo-setting resin 26 is polyurethane, which is applied to both sides 40 and 42 respectively of the woven base 16.

Figure 5:
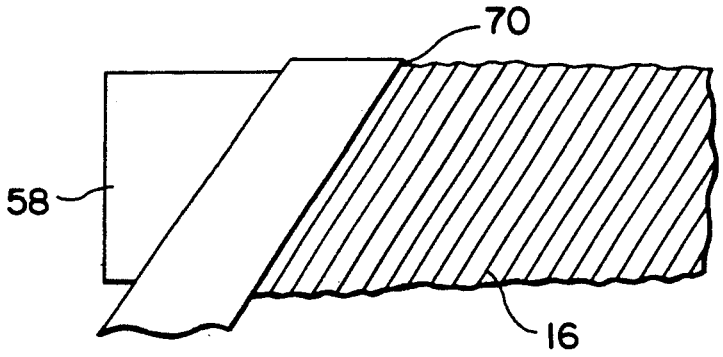
FIG. 5 shows the saturated woven base being spirally wound onto a mandrel.

The woven base 16 with the polyurethane 26 applied to both sides 40 and 42 thereof comprises a spirally wound base, as shown in FIG. 5, with the spirally wound base 16 having an inner and outer polyurethane layer 44 and 46 coated thereon, shown in FIG. 4.

As shown in FIG. 9, the vents 28 to 35 include a plurality of machine directional grooves defined by the thermo-setting resin layer 44. The arrangement is such that in use of the extended nip press 10, water expelled from a felt 48 running contiguously with a formed web W and the blanket 12 through the extended nip press 10, as shown in FIG. 1, is channeled away from the extended nip press 10. When a backing roll 50 of the extended nip press 10 is a plain roll, sufficient venting of the extended nip press 10 is permitted so that a smooth surface 52 of the plain roll 50 directly contacts the web W to impart a smooth surface to the surface 54 of the web W contacting the plain roll 50.

In a preferred embodiment of the present invention, the base 16 includes a first plurality of polyester filaments 18 which are disposed in a machine direction MD. The first plurality of filaments 18 have a modulus of elasticity which permits flexing of the blanket during movement of the blanket 12 through the extended nip press 10.

The second plurality of filaments 20–24 are woven together with the first plurality of filaments 18 and disposed in a cross-machine direction CD. The second plurality of filaments 20–24 are a mixture of a first portion of filaments 20, 23 and 24 which have a modulus of elasticity which is higher than the modulus of elasticity of the first plurality of filaments 18. The mixture also includes a second portion of filaments 21,22 of the second plurality of filaments 20–24, the second portion of filaments 21,22 having a modulus of elasticity approximately the same as the modulus of elasticity of the first plurality of filaments 18 for inhibiting flexing of the blanket 12 in a cross-machine direction CD and for preventing delamination of the blanket 12.

The thermo-setting resin 26 is applied to the base 16 such that the resin is reinforced by the base 16.

The resin 26 defines a plurality of vents 28 to 35 for permitting the escape of water in the liquid and vapor phase away from the extended nip press 10 during use thereof. The second plurality of filaments 20–24 prevent collapse of the vents 28 to 35 during use of the extended nip press 10. The mixture of filaments 20,23 and 24 and 21,22 imparts a greater stiffness to the blanket 12 in a cross-machine direction CD relative to the stiffness of the blanket 12 in a machine direction MD.

In a preferred embodiment of the present invention, the first portion of filaments 20,23 and 24 are of polyester fibers while the second portion of filaments 21 and 22 are of glass fibers.

As shown in FIGS. 4–9, the present invention also includes a method of fabricating a blanket 12 for an extended nip press 10 which includes a shoe 56 and a felt 48. The method includes the sequential steps of weaving a base 16 from a first plurality of filaments 18 disposed in a machine direction MD and a second plurality of filaments 20–24 disposed in a cross-machine direction CD. The first plurality of filaments 18 has a modulus of elasticity which permits flexing of the blanket 12 during movement of the blanket through the extended nip press 10. The second plurality of filaments 20–24 includes filaments having a modulus of elasticity which is higher than the modulus of elasticity of the first plurality of filaments 18 for inhibiting flexing of the blanket 12 in a cross-machine direction CD.

The method also includes the step of simultaneously saturating the woven base 16 on both sides 40 and 42 thereof with polyurethane 26.

The saturated woven base 16 is then wrapped around a smooth mandrel 58 as shown in FIG. 5.

Figure 6:
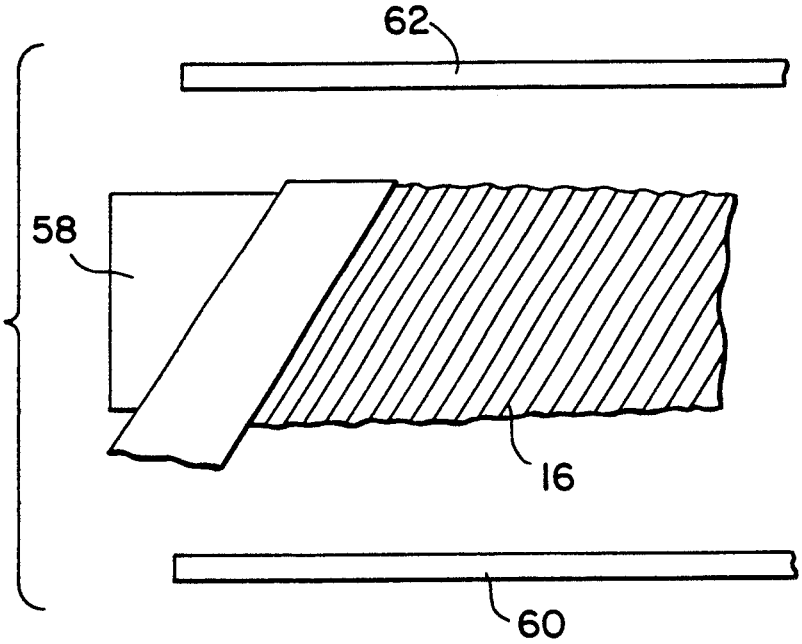
FIG. 6 shows the saturated spirally wound base being heated to cause the polyurethane to gel.

The wrapped mandrel 58 is then heated by heaters 60 and 62 such that the polyurethane 26 gels as shown in FIG. 6.

Figure 7:
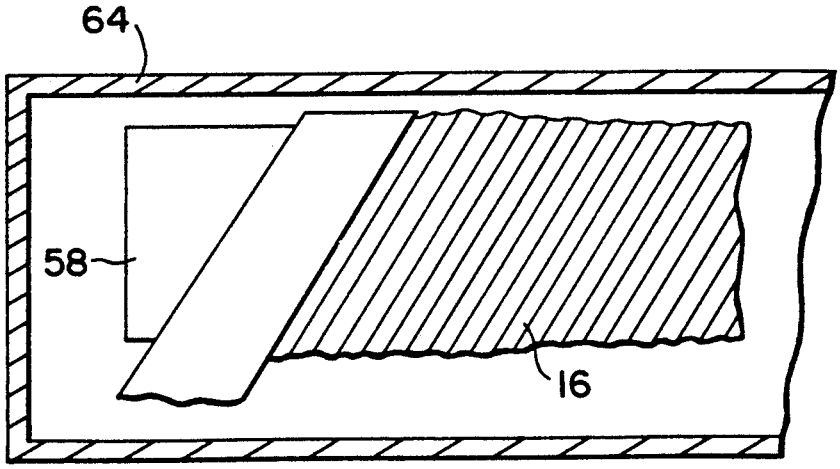
FIG. 7 shows the heating of the semi-cured blanket within an oven.

The wrapped mandrel 58 is further heated, as shown in FIG. 7, within a heating oven 64 for curing the polyurethane 26.

Figure 8:
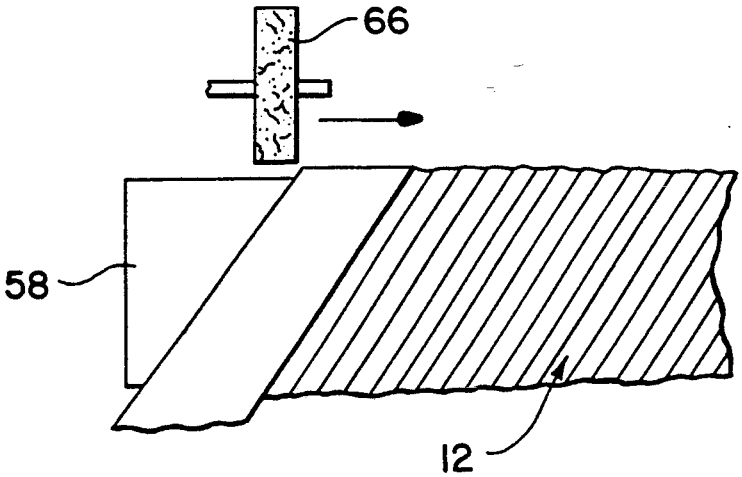
FIG. 8 shows the step of grinding the outer surface of the blanket while the blanket is still on the mandrel.

The cured blanket 12 is then cooled and is then ground, as shown in FIG. 8, the blanket 12 being ground by a grinder 66 to a uniform thickness.

The outer surface 68 of the blanket 12 is then grooved, as shown in FIG. 9, while the blanket is still supported on the mandrel 58.

Finally, the finished blanket is removed from the mandrel 58.

In a preferred method of fabrication of the blanket according to the present invention, the saturated woven base is spirally wrapped around the mandrel 58, the spirally wrapped woven base being overlapped, as indicated by 70, during winding, as shown in FIG. 5, such that the saturated woven base 16 attains a thickness which is greater than the required thickness of the finished blanket.

In the preferred method according to the present invention, the saturated woven base is wound spirally onto the mandrel 58. Therefore, to a certain degree, the first and second plurality of filaments will not be disposed exactly in a machine direction MD and cross-machine direction CD respectively. However, the woven base, having a width of approximately 6 inches and being overlapped, provides filaments which extend approximately in a machine direction MD and cross-machine direction CD respectively, and any reference in this specification to machine direction MD and cross-machine direction CD is to be understood in the aforementioned text.

It is to be understood in the context of the present invention that the various references to the resin defining a plurality of vents is to be interpreted as the reinforced resin defining a plurality of vents because in the practice of the preferred embodiment of the present invention, a saturated woven base approximately 6 to 7 inches in width is spirally wound around the mandrel with each spiral overlapping a preceding spiral and being disposed axially approximately a half an inch relative to the preceding spiral such that the resultant blanket includes 10 to 14 thicknesses of the saturated woven base. Thus as shown in FIG. 2 multiple thicknesses of the saturated woven base are located in land areas (i.e. the ribs) of the blanket between the vents (i.e. the grooves).

Also, throughout the specification, although the saturated woven base is spirally wound around a mandrel, it is to be understood that the present invention is not limited to the use of a mandrel but also includes the provision of a flexible supporting belt or the like.

Additionally, the first plurality of filaments disposed in a machine direction may be of polypropylene and/or other thermo-plastic fibers.

Additionally, in the cross-machine, woof or filling fiber direction, polypropylene, polyester or nylon fibers, or a mixture of the same, may be employed.

The present invention provides a blanket and a method of fabrication thereof which avoids the problem of barrelling and delamination and enables the production of a web having a smooth printable surface thereon.

What is claimed is:

1. A looped non-porous blanket for an extended nip press, said blanket comprising:

a woven base;

said base including:

a first plurality of filaments disposed in a machine direction, said first plurality of filaments having a modulus of elasticity which permits flexing of the blanket during movement of the blanket through the extended nip press;

a second plurality of filaments woven together with said first plurality of filaments and disposed in a cross-machine direction, said second plurality of filaments having a modulus of elasticity which is higher than the modulus of elasticity of said first plurality of filaments for inhibiting flexing of the blanket in a cross-machine direction;

thermo-setting resin applied to said base such that said resin is reinforced by said base; and said resin defining a plurality of vents for permitting the escape of water in the liquid and vapor phase away from the extended nip press during use thereof, said second plurality of filaments preventing collapse of said vents during use of the extended nip press due to said higher modulus of elasticity; said belt being structured and arranged such that in cross section multiple thicknesses of the woven base applied with resin are located in land areas of the blanket between the vents.

2. A blanket as set forth in claim 1 wherein said first plurality of filaments are disposed in a warp direction and are of polyester fibers.

3. A blanket as set forth in claim 1 wherein said first plurality of filaments are disposed in a warp direction and are of nylon fibers.

4. A blanket as set forth in claim 1 wherein said second plurality of filaments are disposed in a woof direction and are of glass fibers.

5. A blanket as set forth in claim 1 wherein said second plurality of filaments are disposed in a woof direction and are of quartz fibers.

6. A blanket as set forth in claim 1 wherein said second plurality of filaments are disposed in a woof direction and are of graphite fibers.

7. A blanket as set forth in claim 1 wherein said second plurality of filaments are disposed in a woof direction and are of aramid fibers.

8. A blanket as set forth in claim 1 wherein said second plurality of filaments are disposed in a woof direction and are of high molecular weight polyethylene.

9. A blanket as set forth in claim 1 wherein said second plurality of filaments are disposed in a woof direction and are of ceramic fibers.

10. A blanket as set forth in claim 1 wherein said thermosetting resin is polyurethane.

11. A blanket as set forth in claim 10 wherein said polyurethane is on both sides of said woven base.

12. A blanket as set forth in claim 11 wherein said woven base with said polyurethane on both sides thereof comprises a spirally wound base with said spirally wound base having an inner and outer polyurethane layer coated thereon.

13. A blanket as set forth in claim 1 wherein said vents include:

a plurality of machine directional grooves defined by said thermo-setting resin, the arrangement being such that in use of the extended nip press, water expelled from a felt running contiguously with a formed web and the blanket through the extended nip press is channelled away from the extended nip press such that when a backing roll of the extended nip press is a plain roll, sufficient venting of the extended nip press is permitted so that a smooth surface of said plain roll directly contacts the web whereby a smooth surface is imparted to the surface of the web contacting the plain roll.

14. A looped non-porous blanket for an extended nip press, said blanket comprising:

a woven base;

said base including:

a first plurality of polyester filaments disposed in a machine direction, said first plurality of filaments having a modulus of elasticity which permits flexing of the blanket during movement of the blanket through the extended nip press;

a second plurality of filaments woven together with said first plurality of filaments and disposed in a cross-machine direction, said second plurality of filaments being a mixture of a first portion of filaments which have a modulus of elasticity which is higher than the modulus of elasticity of said first plurality of filaments, and a second portion of filaments of said second plurality of filaments having a modulus of elasticity approximately the same as the modulus of elasticity of said first plurality of filaments for inhibiting flexing of the blanket in a cross-machine direction and for preventing delamination of the blanket;

thermo-setting resin applied to said base such that said resin is reinforced by said base; and said resin defining a plurality of vents for permitting the escape of water in the liquid and vapor phase away from the extended nip press during use thereof, said second plurality of filaments preventing collapse of said vents during use of the extended nip press, said mixture imparting a greater stiffness to the blanket in a cross-machine direction relative to the stiffness of the blanket in a machine direction, said belt being structured and arranged such that in cross section multiple thicknesses of the woven base applied with resin are located in land areas of the blanket between the vents.

15. A blanket as set forth in claim 14 wherein said first portion of filaments are of polyester fibers;

said second portion of filaments being glass fibers.

* * * * *